US005604958A

United States Patent [19]

Anscher

[11] Patent Number: 5,604,958

[45] Date of Patent: Feb. 25, 1997

[54] ATTACHMENT SYSTEM FOR BACKPACKS, VESTS, BELTS AND THE LIKE

[75] Inventor: Joseph Anscher, Muttontown, N.Y.

[73] Assignee: National Molding Corp., Farmingdale, N.Y.

[21] Appl. No.: 554,069

[22] Filed: Nov. 6, 1995

[51] Int. Cl.[6] ..... A45F 5/02

[52] U.S. Cl. ..... 24/3.1; 224/197; 224/272; 24/163 K; 24/165; 24/265 BC; 24/590

[58] Field of Search ..... 24/163 K, 165, 24/194, 265 BC, 590, 3.1; 2/336, 337, 312; 224/197, 199, 272, 271

[56] References Cited

U.S. PATENT DOCUMENTS

| | | | |
|---|---|---|---|
| 3,080,634 | 3/1963 | Lindblad | 24/590 |
| 3,743,147 | 7/1973 | Wilczynski | 24/590 X |
| 3,878,589 | 4/1975 | Schaefer | 224/272 X |
| 4,419,794 | 12/1983 | Horton, Jr. et al. | 224/272 X |
| 4,488,333 | 12/1984 | Tracy | 24/140 |
| 4,527,760 | 7/1985 | Salacuse | 24/590 X |
| 4,596,504 | 6/1986 | Gunther | 24/590 X |
| 4,605,335 | 8/1986 | Otrusina | 403/348 |
| 4,676,420 | 6/1987 | Sharp | 224/271 |
| 4,718,586 | 1/1988 | Hagino | 224/197 X |
| 4,905,354 | 3/1990 | Smith | 24/590 |
| 5,054,170 | 10/1991 | Otrusina | 224/272 X |
| 5,201,858 | 4/1993 | Otrusina | 224/197 X |

*Primary Examiner*—Peter M. Cuomo
*Assistant Examiner*—Stephen Vu
*Attorney, Agent, or Firm*—Kenyon & Kenyon

[57] ABSTRACT

An attachment system for coupling an object such as a small pouch or case or a tool or flashlight to a belt, backpack, knapsack, vest or the like. The attachment system includes a tab which is sewn to the belt, backpack or etc. . . and which has an elevated region defining a key-like opening. The system also includes a coupling member having a key-like structure which may be inserted into the opening in the tab member, and which may be rotated between a position wherein the coupling member is secured to the tab member and a second position wherein the coupling member may be detached from the tab member. The coupling member may be attached to a pouch or small case. In another embodiment, the coupling member can releasably attach the shaft of a tool or flashlight.

9 Claims, 8 Drawing Sheets

FIG. 3
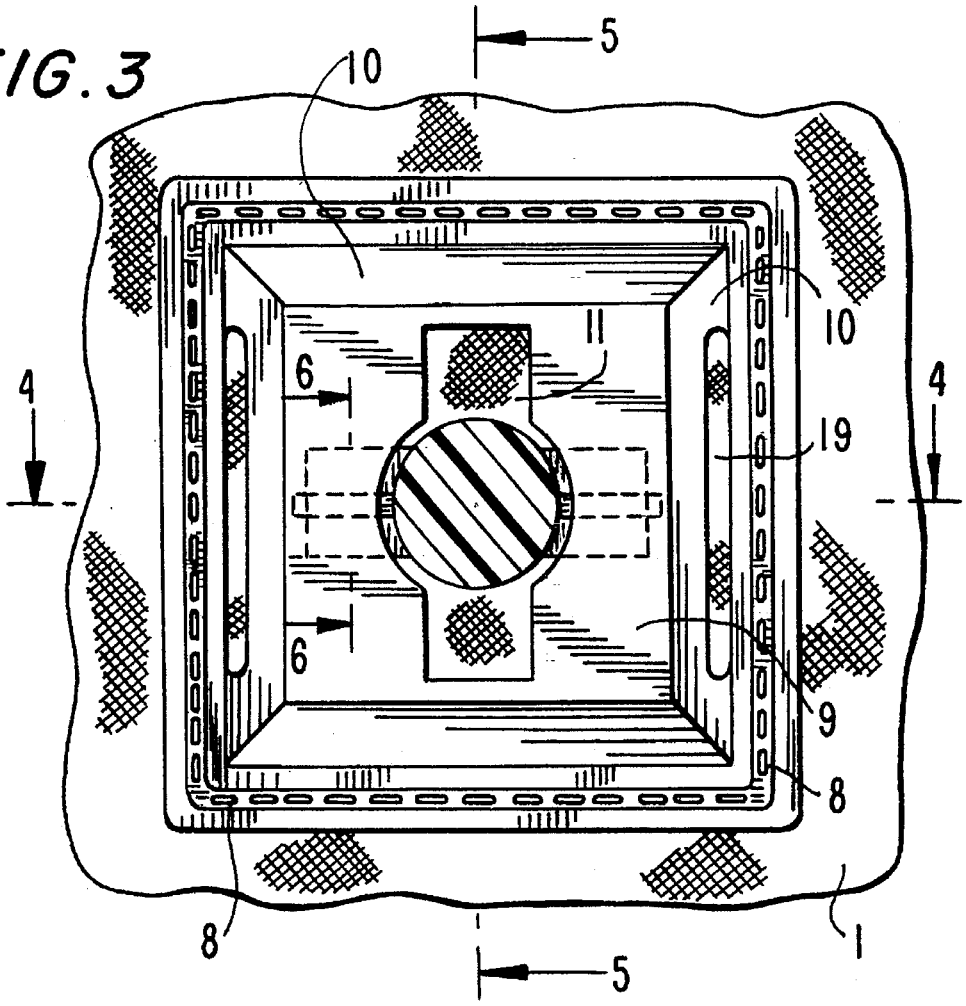
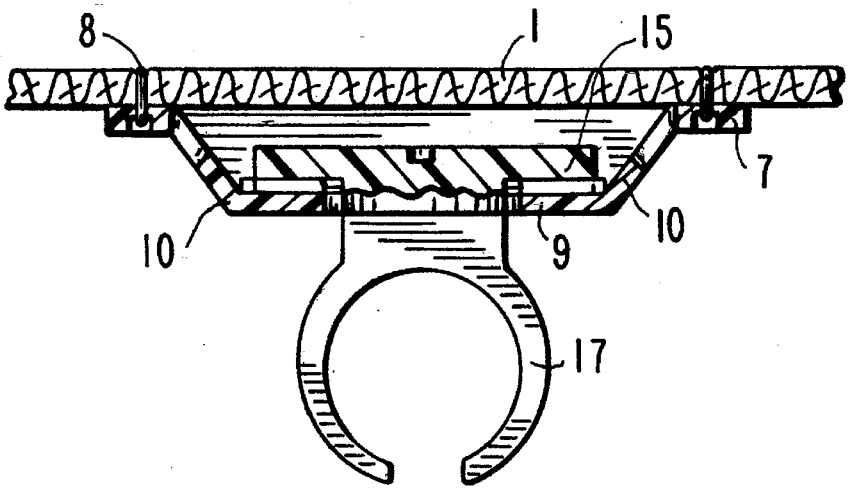
FIG. 4

FIG. 5
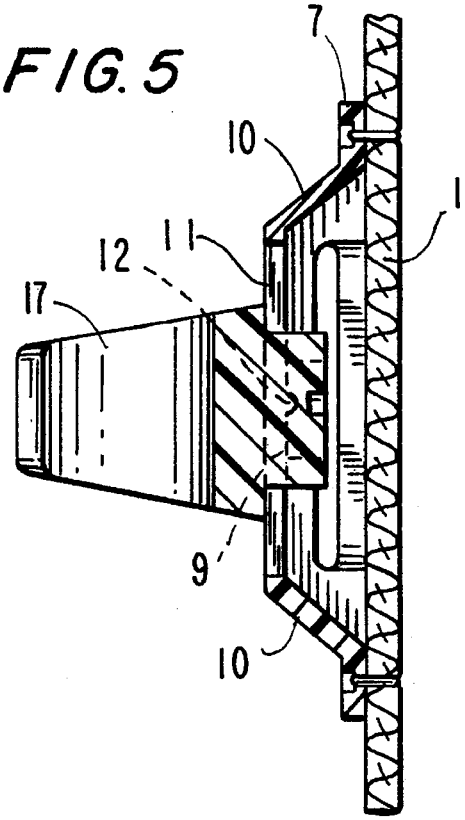
FIG. 6
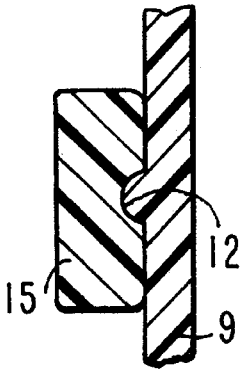
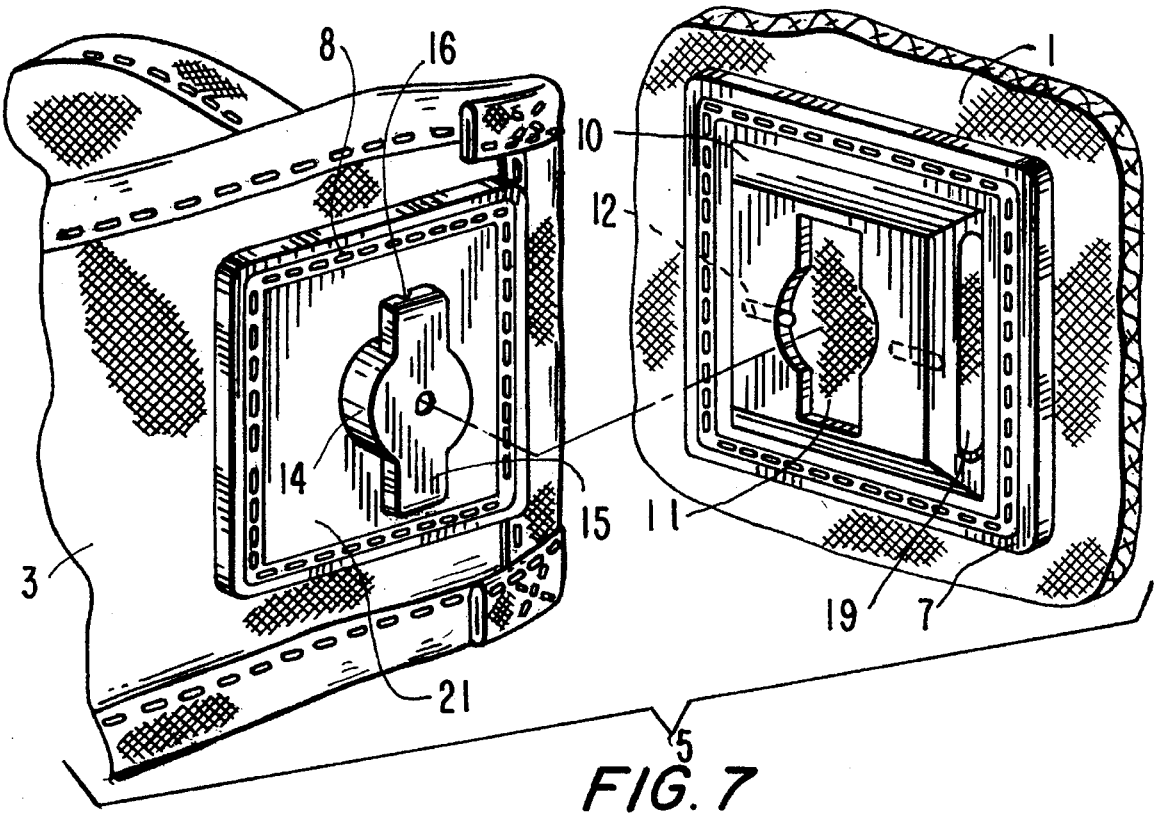
FIG. 7

ATTACHMENT SYSTEM FOR BACKPACKS, VESTS, BELTS AND THE LIKE

BACKGROUND OF THE INVENTION

1. Field of the Invention

The invention relates to a system for attaching an assortment of personal items, ordinarily carried by persons engaged in hiking or mountain climbing and the like, to a backpack, knapsack, rucksack, travel bag, fishing vest, lumbar pack, hiking belt or the like for easy attachment and detachment by the user.

2. Description of Related Art

Hiking, fishing, rock climbing, etc. . . in wilderness areas are popular recreational past times. Persons who take part in such activities usually wear a backpack, vest or the like to carry an assortment of objects which become necessary or desirable during the activity. Such objects include a water bottle, first aid, tools, flashlight, food, eyeglasses and various other personal items. During rock climbing and mountain climbing, a person may also wear a belt which conveniently attaches climbing implements (e.g., an ice axe), tools, and other personal items for easy access. It is also common to attach small, modular pouches to the outside surfaces of backpacks, belts and the like. Such modular pouches can hold various personal items, such as a small water bottle.

It should be appreciated that the climber's or hiker's access to tools and the like is advantageously quick and convenient. Such items are commonly attached to canvas backpacks or vests, or to belts, using a strap and a buckle or other fastener for securing the strap. The strap is secured to the canvas backpack via a lash tab. A lash tab is generally a plastic square which is sewn to the canvas of the backpack. The lash tab includes an elevated region which is spaced from the outside surface of the backpack and which defines a pair of slots on opposite sides thereof for receiving a strap or webbing therethrough. The strap then secures the object to be attached to the backpack via a buckle or other fastener. An example of a lash tab is the subject of U.S. Pat. No. 4,488,333. The lash tab/strap/fastener combination is also a common way to attach other items, such as modular pouches used to hold water bottles, to a backpack or belt.

One drawback to the lash tab/strap/fastener system is that the webbing must be properly fed and adjusted through the buckle or fastener to securely attach the modular pouch or the like to the belt or backpack. The webbing must be removed and adjusted each time to slide the modular pouch in place. This requires some dexterity on the part of the user, however, in some situations, particularly in cold weather where gloves or mittens are worn, feeding and adjusting a strap is not convenient. An additional drawback is that the known system cannot be effectively used on fly fishing vests. Therefore, it would be desirable to have an attachment mechanism which requires little or no dexterity, and which allows for easier and more convenient attachment and detachment of an assortment of items to a backpack, belt, vest or the like.

My U.S. Pat. No. 5,435,045 meets this need with respect to certain tools which are commonly attached to backpacks, such as ice axes and picks. This patent teaches a tension fastener which eliminates the need for the use of a strap and buckle to attach such tools to the backpack. Although this tension fastener is effective for conveniently attaching certain tools to backpacks and the like, it is not universal in its application and because personal items cannot be attached using the tension fastener. For example, use of the tension fastener is not a convenient and effective way to attach a modular pouch to a backpack or a climbing belt.

Therefore, it would be desirable to have an attachment system for backpacks, rucksacks, travel bags, knapsacks, lumbar packs, fishing vests, hiking belts and the like which easily and conveniently attaches a wide assortment of different objects.

SUMMARY OF THE INVENTION

Accordingly, it is an object of the invention to provide an attachment system for backpacks, rucksacks, travel bags, lumbar packs, knapsacks, fishing vests, climbing belts and the like which is capable of effectively and conveniently attaching a variety of different objects.

It is a further object of the invention to provide such an attachment system which requires little dexterity on the part of the user.

It is another object of the invention to provide an attachment system for backpacks, bags, packs, vests, knapsacks, belts and the like which does not require the use of an adjustable webbing/buckle combination.

These and other objects of the invention, which will become evident from the detailed description of the invention set forth herein, are achieved by the following attachment system. The system includes a pair of mating members. The first member is a generally flat tab which is sewn around its edges to the pack, bag, vest or belt. The first member has an elevated region in the center thereof which is spaced from the exterior surface of the pack to which it is sewn. The center of the elevated region defines a key-like aperture.

The second member has a projection having a pair of laterally projecting wings which are adapted to be inserted into the key-like aperture in the first member. To secure the second member to the first member, the second member is completely inserted into the first member and then rotated by 90° so that the wings will be situated beneath the elevated region of the first member.

In one embodiment, the second member is permanently attached to the object to be attached to the backpack, vest or belt, e.g. by sewing the second member to the modular pouch or other object to be attached to the backpack. In another embodiment, the second member is formed with a ring, a catch or the like for detachably coupling the shaft of a tool or flashlight.

In yet another embodiment of the invention, the second member includes two parts: a tab which is permanently attached to the pouch or other object which is to be attached to the backpack, vest, etc., and a part which has the wings which is coupled to an opening in the tab. The part which has the wings is rotatable within the opening in the tab member in which it is housed by moving a lever arm which projects from a slot in a side wall of the tab. In accordance with this embodiment of the invention, it is only necessary to move the lever to lock and unlock the second member from the first member. The object itself to which the second member is attached need not be rotated.

In all embodiments, the space between the outer surface of the backpack, vest or belt and the elevated region of the first member is such that it is slightly less than the thickness of the wings of the second member so that a snug, tight fit is provided when the wings are forced into the space. This helps to retain the second member in a stable position. In addition, the upper surface of the wings may be provided with a groove or dimple for receiving a bump in the elevated region of the first member to further stabilize the position of the second member.

The first member may be provided in the form of a lash tab having a pair of slots on opposite sides of the elevated region. In this way, in addition to attaching the second member, the first member can also function to serve as a means for attachment of a strap, if desired.

BRIEF DESCRIPTION OF THE DRAWINGS

FIG. 3 is a top planar view of one embodiment of the attachment system of the invention taken along the line 3—3 of FIG. 1.

FIG. 4 is a cross-sectional view of the embodiment illustrated in FIG. 3 taken along the line 4—4.

FIG. 5 is a cross-sectional view of the embodiment of FIG. 3 taken along the line 5—5.

FIG. 6 is an isolated view of the locking mechanism of the attachment system of FIG. 3, taken along the line 6—6.

FIG. 7 is an exploded view of a second embodiment of the attachment system of the invention.

DETAILED DESCRIPTION OF THE INVENTION

Figure 1:
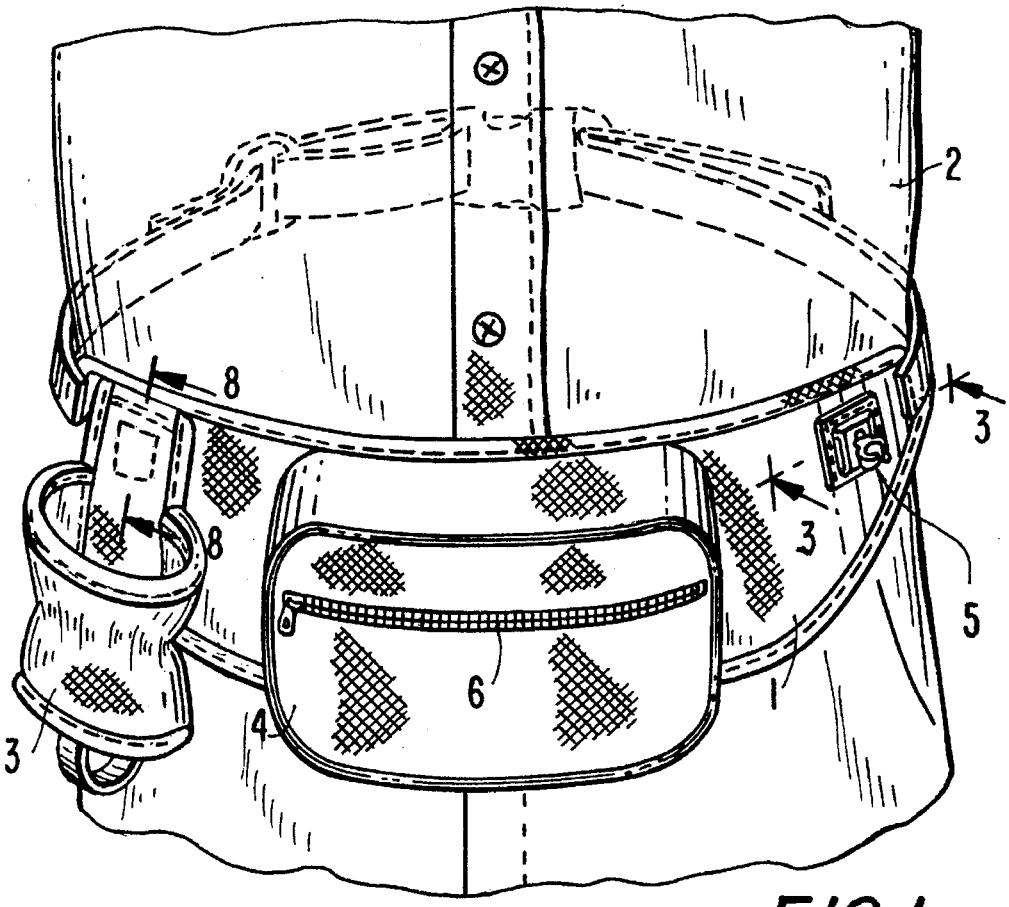
FIG. 1 is a frontal view of a belt having a number of different objects for holding hiking accessories attached to it using the attachment system of the invention.

Referring to FIG. 1, a hiking or climbing belt 1 which may be used with the attachment system of the invention is illustrated around the waist of a user 2. Although the invention will be described herein with reference to its attachment to a hiking belt, it should be appreciated that the attachment system can also be used with a backpack, rucksack, knapsack, lumbar pack, vest (e.g., hunting or fishing vests, a life preserver, etc. . . ). The belt 1 holds a number of different objects on its outer surface, including a pouch 3, a small case 4, and an attachment member 5 for a tool or the like. Case 4 may be opened and closed by a zipper 6, and is designed to hold an assortment of personal items of the user 2. Pouch 3 can carry a personal item such as a water bottle. Attachment system 5 may be used to hold a tool or flashlight or other implement as will be described hereinafter. It will be appreciated that the number and type of objects attached to the belt using the attachment system of the invention will vary widely depending upon the user's requirements. Thus, the number and kind of objects attached to the belt in FIGS. 1–9 is merely by way of example.

An exploded view of the first embodiment of the attachment system 5 of the invention which can hold a tool is illustrated in FIGS. 2–6. The system includes a tab member 7 which is attached to the outer surface of the belt 1 (or a pack, bag or vest, as the case may be). Preferably, tab 7 is attached by sewing it to the belt with a strong nylon thread 8 near its edges. For this purpose, tab 7 is preferably molded from relatively soft plastic.

Figure 2:
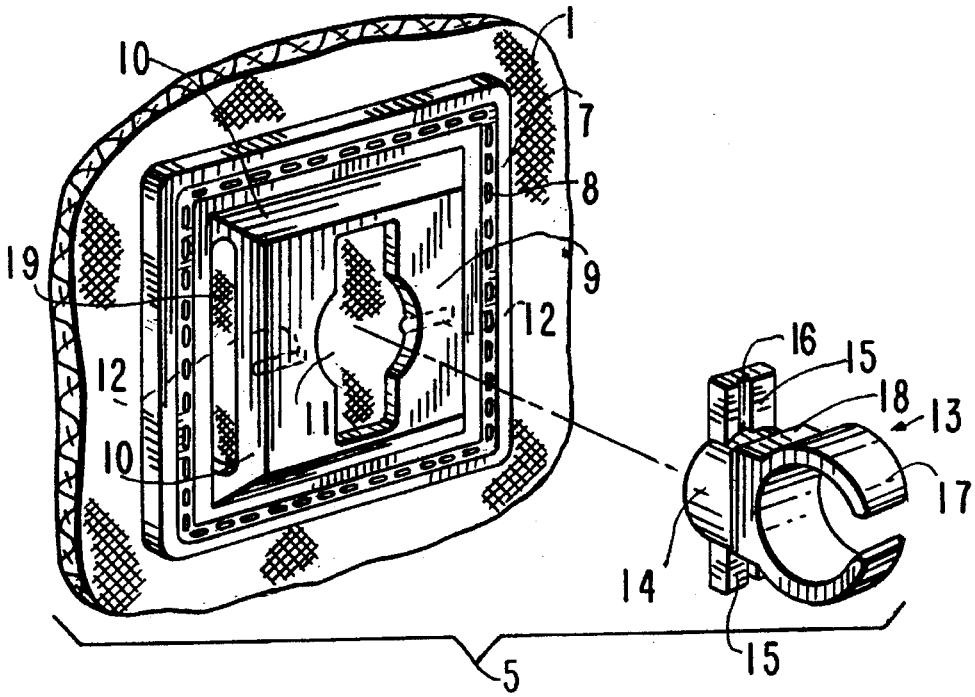
FIG. 2 is an exploded view of one embodiment of the attachment system of the invention.

Tab 7 includes an elevated region 9 in the central region of the tab inside the stitching 8. The elevated region 9 is spaced away from the outer surface of the belt 1 to define a gap therebetween. The elevated region 9 is joined to the outer region of the tab 7 by four side walls 10. Elevated region 9 defines a key-like hole 11 therein. As illustrated in FIG. 2, key-like aperture 11 includes a central circular region and a pair of contiguous rectangular regions which are spaced 180° apart around the circular region. The aperture 11 exposes the outer surface of the belt 1 to which the tab 7 is attached.

The inner side of the elevated region 9 which faces the outer surface of the belt 1 includes a pair of bumps 12, illustrated in phantom in FIG. 2 (see also FIGS. 3, 5 and 6). Each bump 12 extends laterally away from the circular region of aperture 11 toward a side wall 10. The bumps 12 are spaced 180° apart from each other around the periphery of the circular region of the aperture 11, and 90° away from each rectangular region of aperture 11, as illustrated in FIG. 2.

The attachment system 5 also includes an attachment member 13 shown separated from the tab member 7 in the exploded view of FIG. 2. Attachment member 13 includes a key-like structure 14, 15 which is adapted to mate with the key-like aperture 11 of the tab member 7. The key-like structure includes a cylindrical region 14 and a pair of laterally projecting rectangular wings 15 which are spaced 180° apart around the periphery of the cylindrical region 14. The shape and size of the key-like structure is such that it fits within the key-like hole 11 of the tab member 7. In addition, the thickness of the wings 15 is such that they can be snuggly received underneath the elevated region 9 of the tab member 7, in the gap between the outer surface of belt 1 and the inner side of the elevated region 9, when the attachment member 13 is rotated after it is fully inserted into the aperture 11. Each wing 15 also includes a groove or dimple 16 extending from the cylinder 14 to the end of the wing. The grooves 16 are adapted to mate with the bumps 12 on the inner surface of the elevated region 9 of the tab 7.

In the embodiment of the invention of FIGS. 2–6, the attachment member 13 includes an attachment ring 17 projecting from a base region 18 of the attachment member. As illustrated in FIGS. 2 and 4, attachment ring 17 is open to permit insertion of the shaft of a tool, flashlight or the like. For this purpose, the attachment member 13 is preferably molded from a resilient plastic which will permit a snap-fit by the open ring 17. Attachment member 13 may also be machined from a flexibly resilient metal which will allow for the snap-fit of a tool in the ring 17. Thus, the shaft of the tool or other implement can be forced into the open section of the ring, and the ring will snap close around it to securely hold the implement. Of course, the diameter of the ring 17 must be slightly smaller than the diameter of the shaft of the tool to be held. Therefore, it is contemplated that a large number of attachment members 13 having different sized rings 17 will be provided for allowing the user to attach an assortment of different tools.

In order to couple the attachment member 13 to the belt 1, key-like structure 14, 15 is first fully inserted into the key-like hole 11 of the tab member 7 so that the wings 15 are situated in the gap between the elevated region 9 and the outer surface of the belt 1. The attachment member 13 is then rotated 90° within the aperture 11 while simultaneously applying pressure on the attachment member 13 toward the belt 1 to ensure that the wings 15 are forced beneath the elevated region 9. Preferably, the thickness of the wings 15 is slightly greater than the gap between the elevated region 9 and the belt 1 so that pressure is required to force the wings 15 beneath the elevated region 9. In this way, the wings 15 will be securely held in position as the belt 1 will push up against the wings. Although this pressure will ordinarily be enough to hold the attachment member 13 in a stable position, preferably the cooperating bumps 12 and grooves 16 are also provided to promote the stability of the attachment member in the locked position. After rotating 90° to position the wings beneath the elevated region, the grooves 16 on the wings 15 will receive the bumps 12 on the inner surface of the elevated region 9 to hold the attachment member 13 in a "locked" position. The engagement of the bumps 12 and grooves 16 is best illustrated in the isolated, cross-sectional view of FIG. 6.

To decouple the attachment member 13 from the tab 7, the user pushes the attachment member 13 toward the belt 1 while simultaneously rotating it by 90° in any direction to align the wings 15 with the rectangular areas of the key-like opening 11. In this unlocked position, the attachment member 13 may be removed from the opening 11. Of course, other attachment members having rings or clamps of different sizes may be substituted to accommodate tools or flashlights of different sizes. It should also be appreciated that in lieu of ring 17, the attachment member 13 may define other means for attaching a tool, such as a clamp, catch, clasp or other fastener. In the second embodiment of the invention described below, the ring 17 is replaced by a tab which is permanently secured (e.g., by stitching or adhesive) to the object to be attached to the belt 1.

In a preferred embodiment, the belt, pack, bag or vest to which tab 7 is attached is padded (e.g., with foam or stuffing) beneath its outer surface. The padding will function to push on the wings 15 when they are forced beneath the elevated region 9 in the space between the padding and the inner surface of the elevated region, so as to help retain the wings in the locked position. In any event, the outer surface of the belt, pack, bag or vest, to which tab 7 is attached, should have sufficient integrity or be sufficiently taut to create a tight fit of the wings 15 in the space between the outer surface and the elevated region 9 of the tab. However, if such is not the case, tab 7 itself may be provided with a bottom wall (not illustrated) for this purpose. The gap between the bottom wall and the elevated region 9 should form a tight fit for the wings 15. The inner surface of the bottom wall may be padded for this purpose.

Figure 9:
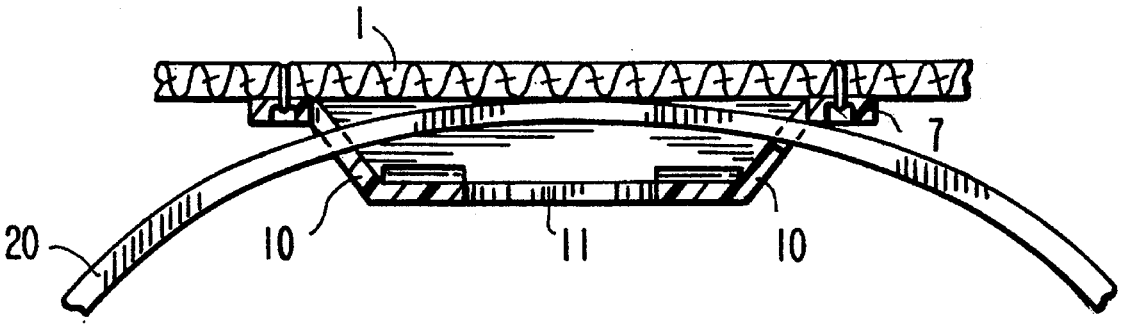
FIG. 9 illustrates the strap attachment function which the attachment system of the invention can also perform.

In a preferred embodiment, a pair of opposite side walls 10 of tab 7 defines slots 19 which are adapted to receive a strap or webbing therethrough. As known in the art, the strap received through such slots can couple an object to the object to which the tab 7 is attached. FIG. 9 illustrates a strap 20 fed through slots 19 in side walls 10 of tab 7. As known in the art, the ends of the strap 20 are coupled by an adjustable fastener or buckle (not illustrated) to hold an object against the belt 1 (or other item to which the tab 7 is stitched). Thus, the attachment system of the invention can be used to attach two different objects using a single tab 7.

Figure 8:
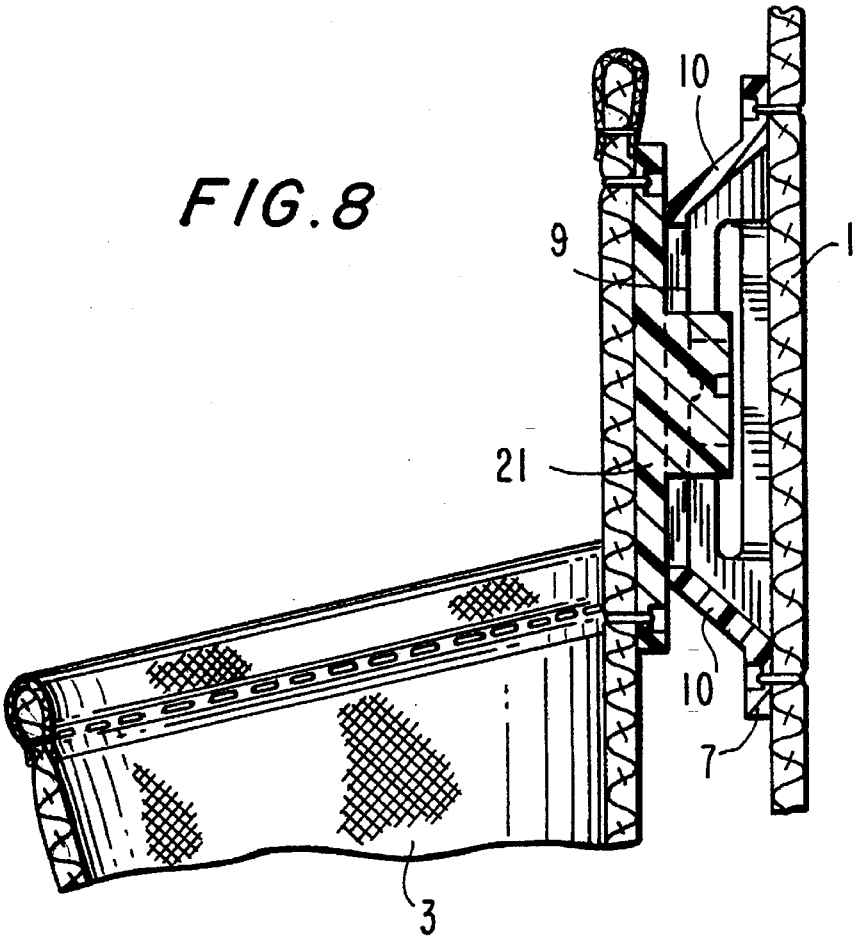
FIG. 8 is a cross-sectional view of the second embodiment taken along the line 8—8 of FIG. 1.

A second embodiment of the invention is illustrated in FIGS. 7–8 where like reference numerals designate like or corresponding parts from the first embodiment. As in the first embodiment, tab 7 is permanently attached to belt 1 (or to a backpack, bag, vest, etc. . . ). Tab 7 is identical in all respects to the tab of the first embodiment.

A second tab member 21 is permanently attached to a pouch 3 by stitching 8 or the like. For this purpose, tab 21 is preferably molded from a relatively soft plastic material as in the case of tab 7. Tab 21 includes a key-like structure 14, 15. As in the first embodiment, the key-like structure includes a cylindrical region 14 and a pair of contiguous rectangular wings spaced 180° apart around the periphery of the cylindrical region. As in the first embodiment, at least one wing 15 includes a groove 16 which is adapted to mate with a bump 12 in the tab 7.

Pouch 3 (which may be used to hold a small water bottle) is coupled to belt 1 by fully inserting key-like structure 14, 15 into key-like opening 11 of tab 7, and then rotating the pouch 90° to position the wings 15 beneath the elevated region 9 to align the groove(s) 16 with the bump(s) 12. As in the first embodiment, the gap between the elevated region 9 and the outer surface of the belt 1 should be such that it snuggly receives the wings 15 to hold the tab 21 in the locked position. Of course, to decouple the pouch 3 from the belt 1, the user applies pressure on the tab 21 in the direction of the belt 1 while simultaneously rotating the pouch (and consequently the tab 21) by 90° to align the wings 15 with the rectangular regions of the key-like opening 11.

It should be appreciated that by using the second embodiment of the attachment system of the invention just about any kind of pouch or case can be attached to belt 1, or to a backpack, bag, vest, etc. . . , to which tab member 7 is attached. For example, case 4 may be attached by stitching tab 21 to the backside thereof, and then attaching tab 21 to a tab member 7 attached to belt 1 (or to a backpack, etc. . . ). Of course, it will be appreciated that tab member 21 should be stitched to pouch 3 or case 4 with the wings 15 in the proper orientation, such that when the wings 15 are positioned in the locked position beneath the elevated region 9, the pouch will be in the desired position (presumably, the upright position illustrated in FIG. 1).

An important advantage of the invention lies in its versatility with respect to the number of different objects which can be attached to a belt, backpack, vest or the like. Thus, tabs 21 may be permanently attached to a variety of different objects which may be substituted for one another on a tab 7, which is attached to the belt, backpack, vest or the like. Since coupling and decoupling is accomplished merely by rotating the attached object (and consequently the tab member 21), little dexterity is required on the part of the user.

Thus, a user wearing gloves or mittens will not have difficulty. On the other hand, in accordance with the prior art method of attachment which relies upon webbing and an adjustable fastener, greater dexterity is required. In addition, an important limitation on the prior art system of attachment is that some objects simply cannot be effectively attached to a backpack or the like using the strap/fastener combination. On the other hand, using the attachment system of the invention, a wide variety of objects may be attached to either tab 21 of the second embodiment, or to attachment member 13 of the first embodiment.

A third embodiment of the attachment system of the invention is illustrated in FIGS. 10–17. This third embodiment of the invention is useful for attaching relatively large objects to a pack, vest or the like. When attaching large objects, such as a large pouch which is capable of holding a number of different items, it may be desirable to use a pair of tabs 7 on the backpack, vest, etc. and a corresponding pair of second tab members 21 on the large pouch which is to be attached to the backpack or vest. However, it will be appreciated that the second embodiment of the invention is not suitable when a pair of tabs 7 and second tab members 21 are used because it would be impossible to rotate the pouch so as to align the wings 15 beneath the elevated region 9 of the tab member 7.

The third embodiment of the invention which will now be described modifies the second tab member 21 so that rotation of the pouch itself is not required to lock the second tab member 21 to the tab 7. Thus, the third embodiment of the invention is useful for attaching relatively large pouches to a backpack or the like in situations where it is necessary or desirable to employ a pair of tabs 7 (or more) for greater stability. The third embodiment of the invention will be described in connection with attaching a relatively large pouch 25 to a backpack 26, however, this is merely by way of example as the third embodiment can be used to attach a wide variety of different objects to a backpack, vest, belt, etc. In FIGS. 10–17, like reference numerals used in FIGS. 1–9 are used to designate like or corresponding parts.

Figure 10:
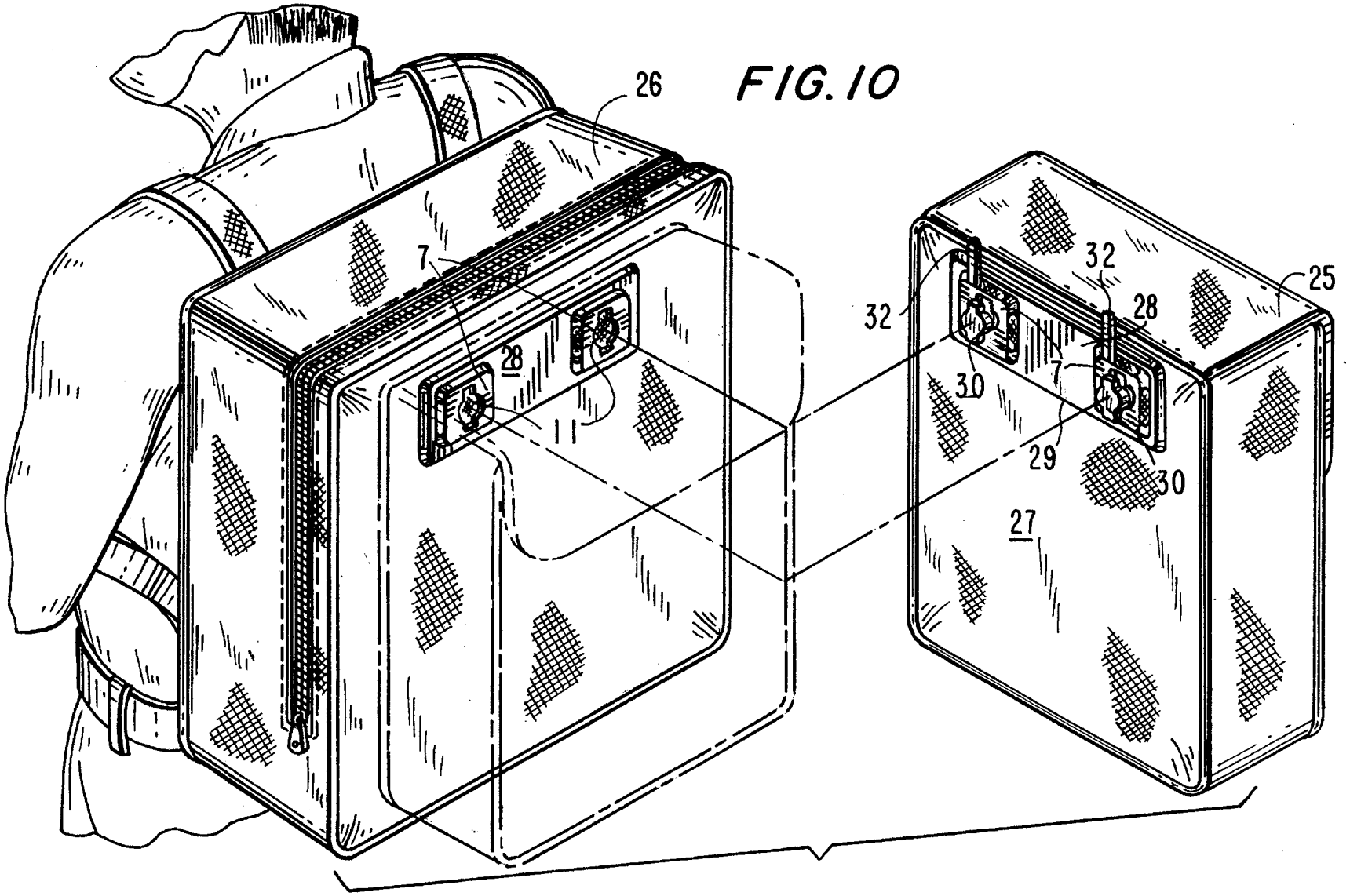
FIG. 10 is an exploded view of a third embodiment of the attachment system of the invention as used to attach a large pouch to a backpack.

The attachment system includes one or more tabs 7 which are attached (e.g., by stitching) to the outer surface of backpack 26. In FIG. 10, a pair of tabs 7 is employed, however, fewer or more tabs may be used depending upon how large of an object is to be attached to the backpack. The tabs 7 are identical to the tabs 7 described in the preceding embodiments of the invention, and therefore a detailed description of their structure will not be repeated here.

A second pair of tab members 7 is permanently attached (e.g., by stitching) to the back surface 27 of the pouch 25 which is to be attached to backpack. This second pair of tab members 7 is preferably molded as a single piece as illustrated in FIG. 10. When molded in a single piece, the tab members 7 are situated on a support surface 28 which is stitched around its periphery 29 to the back surface 27 of the pouch 25. The tabs 7 which are attached to the pouch are preferably molded together in a single piece with support 28 in order to ensure perfect alignment with their counterparts on the backpack, however, they may also be provided as separate members attached to the pouch, if desired. For better alignment, the tabs 7 which are attached to the backpack surface 26 may likewise be molded on a support 28 as a single piece.

Figure 17:
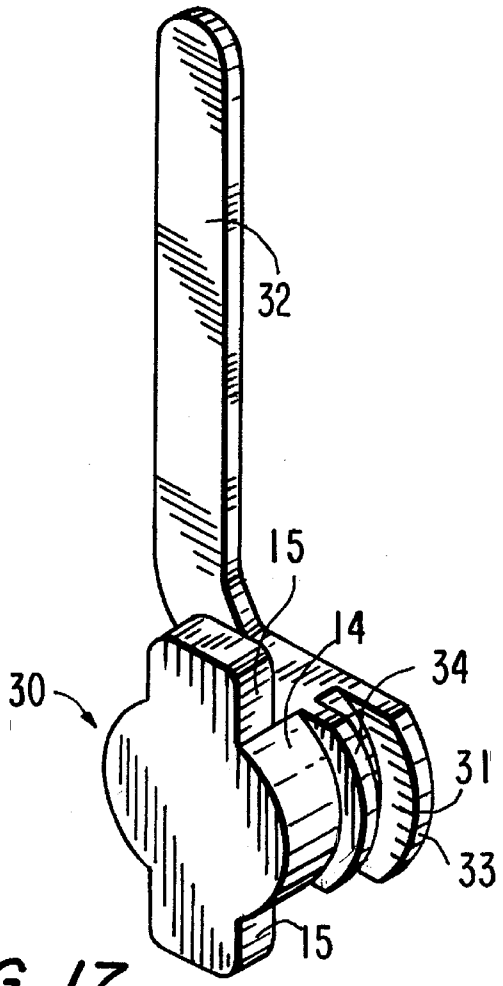
FIG. 17 is an isolated, perspective view of the key-like member/lever arm of the third embodiment of the attachment system of the invention.
Figure 16:
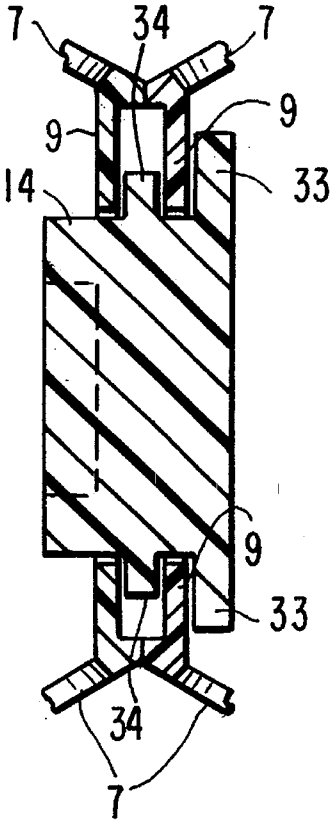
FIG. 16 is an isolated view of the rotational coupling of the key-like member to a tab of the attachment system taken along the line 16—16 of FIG. 14.
Figure 15:
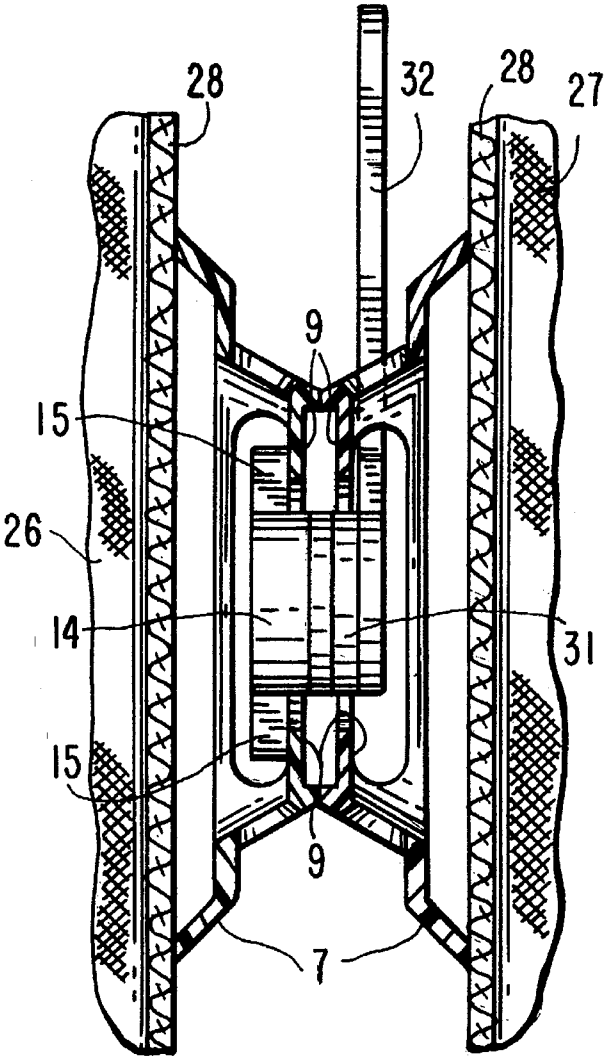
FIG. 15 is a cross-sectional view of the attachment system in the locked position taken along the line 15—15 of FIG. 14.

The tabs which are attached to the pouch 25 are each coupled to a key-like member 30. Referring to FIG. 17, the key-like member 30 includes a cylindrical region 14 and a pair of contiguous rectangular wings 15 spaced 180° apart around the periphery of the cylindrical region. The key-like member 30 is rotatably coupled to the tab 7 which is attached to the pouch 25. For this purpose, the cylindrical region 14 of the key-like member defines a groove 31 between groove defining members 33, 34 disposed around at least a portion of its circumference. The groove 31 slidably receives the circular edge of the aperture 11 defined in the elevated region 9 of tab 7 (see FIG. 16). In this manner, the cylindrical region 14 of the key-like member 30 is rotatable within aperture 11 in the elevated region 9. The key-like member 30 is configured such that the wings 15 are situated well above the elevated region 9 and aperture 11 of the tab 7 which is attached to the pouch 25, 27 as illustrated in FIG. 15. In this manner, the key-like member is free to rotate within the aperture 11, and this rotational movement is not restricted by the wings 15.

The cylindrical region 14 of each key-like member 30 has a lever arm 32 projecting laterally therefrom. The lever arm 32 enables the user to easily rotate the key-like member 30. The lever arm 32 extends through a slot 19 defined in a side wall of tab 7 to permit a user to grab the lever arm. In order to rotate the key-like member 30, the user simply moves the lever arm 32 between one side of the slot 19 and the other. The range of motion of the lever arm within the slot 19 will be limited by the ends of the slot 19, thereby permitting the cylindrical region 14 of the key-like member 30 to be rotated by at least about 45° (compare the positions of the wings 15, which are illustrated only in phantom, and the lever arms 32 in FIGS. 11 and 13). If desired, the slot 19 can be manufactured longer, for example by widening the tab, so that a larger range of motion can exist for the lever arm 32 to enable the wings 15 to be rotated by 90° (as is possible in the first two embodiments). Rotation by 90° would also be possible by simply molding the tab so that the ends of slot 19 are extended down to the adjoining sides, whereby a greater range of motion for the lever arm 32 will be permitted. Of course, it can be appreciated that other configurations are also possible for extending the allowable range of motion of the lever arm.

Thus, it can be seen that each key-like member 30 is permanently coupled to each tab 7 which is attached to the pouch 25 because the edge of aperture 11 on the tab 7 is received within the groove 31 of the key-like member. In addition, the lever arm 32 which extends through the slot 19 also helps to retain the key-like member within the tab 7 which is attached to the pouch 25. Nevertheless, during manufacturing, the key-like members 30 are molded separately from the tabs 7/support surface 28. The key-like member 30 is permanently coupled to the tab 7 which is attached to the pouch 25 by inserting lever arm 32 through aperture 11 and then through slot 19 in the tab, and subsequently snap-fitting groove 31 on the edge of the aperture 11 in the elevated region 9. For this purpose, both the key-like member 30 and the tab 7 are molded from a resiliently flexible plastic.

The tabs 7 which are attached to the back surface 27 of pouch 25 are attached in a position such that the lever arms 32 will be accessible to the user. In other words, when the pouch 25 is coupled to the backpack 26, the lever arms must project out from the top (or from the top and bottom, or from a side) of the pouch when it is attached to the backpack so that the lever arms are accessible to the user. Thus, the tabs 7 should be attached to the back surface 27 of the pouch 25 in the vicinity near an edge of the back surface, for example near the top edge as illustrated in FIG. 10. Alternatively, the lever arms 32 should be long enough so as to be accessible regardless of where the tabs are positioned.

Figure 12:
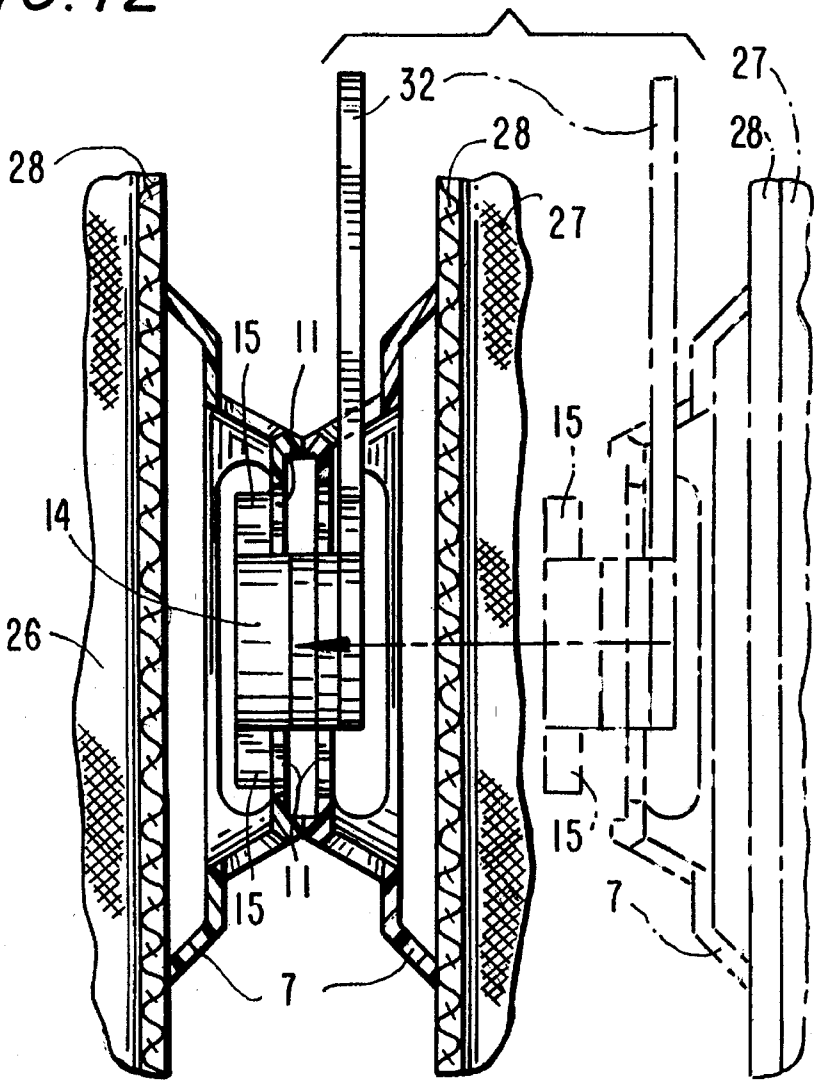
FIG. 12 is a cross-sectional view of the attachment system illustrated in FIG. 11, taken along the line 12—12, with one part thereof illustrated in phantom.
Figure 11:
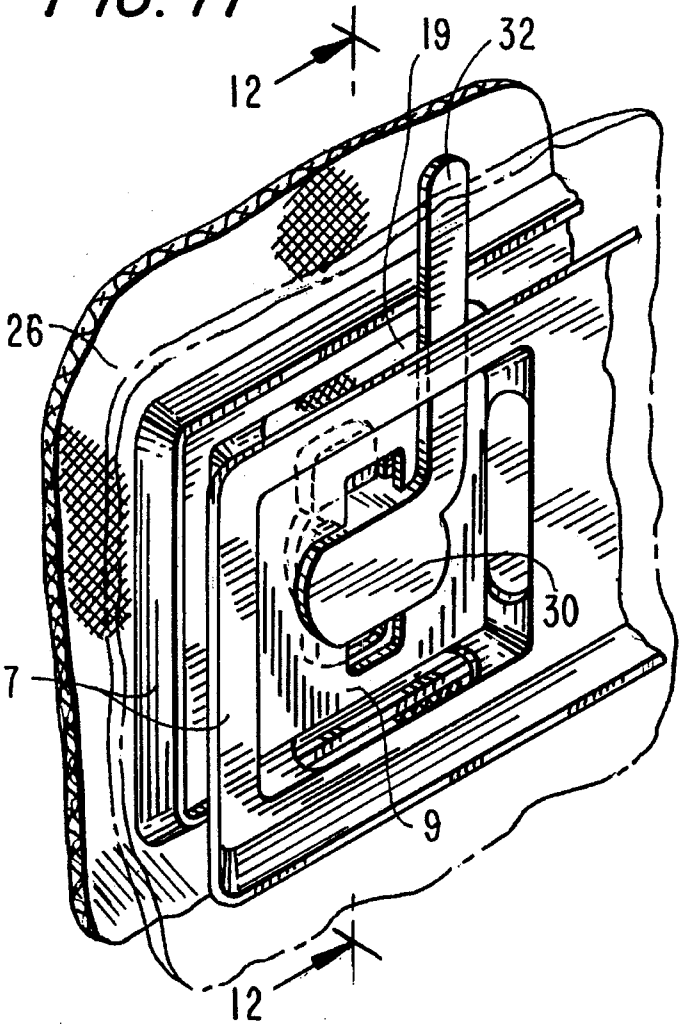
FIG. 11 is a detailed, isolated view of the attachment system in the unlocked position as it would be viewed when looking towards the backpack from the pouch if the pouch were invisible.
Figure 14:
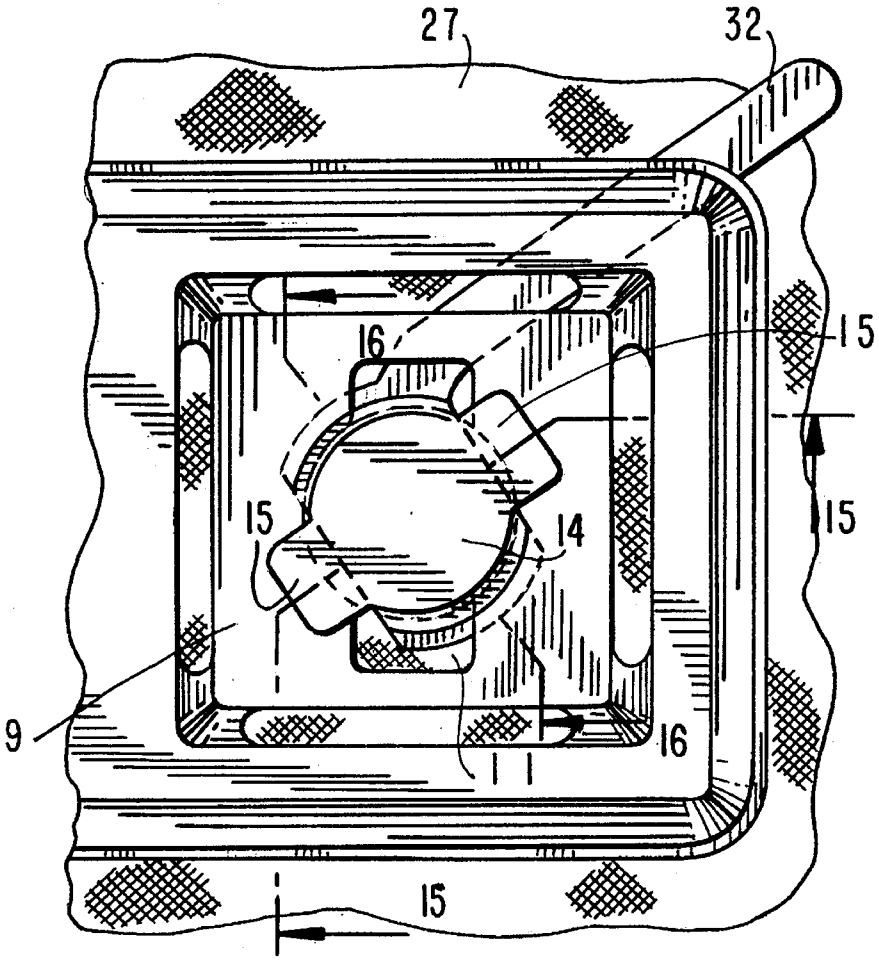
FIG. 14 is a view of the attachment system taken along the line 14—14 of FIG. 13, which would be the view looking towards the pouch from the backpack if the backpack were invisible.
Figure 13:
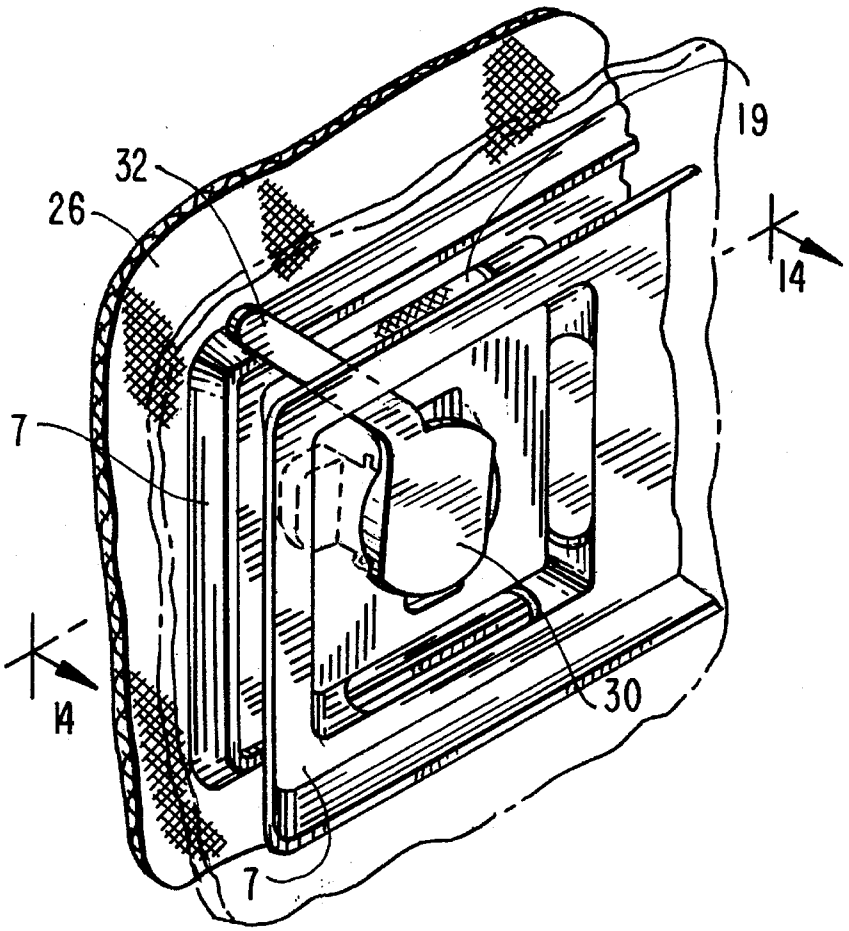
FIG. 13 is the same view of the attachment system illustrated in FIG. 11, except the attachment system is illustrated in the locked position.

In order to attach the pouch 25 to the backpack 26, the wings 15 of the key-like members 30 which are coupled to the pouch 25 are inserted into the aperture 11 of each tab 7 attached to the backpack 26 (see FIG. 12 where the step of insertion is illustrated in phantom in the direction of the arrow). For this purpose, the tabs 7 on the pouch 25 must be aligned perfectly with the tabs 7 on the backpack 26. FIGS. 11 and 12 illustrate the attachment system in the unlocked position, where the wings 15 are aligned with the rectangular regions of aperture 11 in the tab attached to backpack 26. In order to position the wings 15 beneath the elevated region 9 of the tab 7 attached to the backpack 26, each key-like member 30 is rotated by moving each lever arm 32 across the slot 19, whereby the cylindrical region of each key-like member rotates by about 45°. In this locked position (see FIGS. 13–15), the wings 15 are no longer aligned with the rectangular regions of the aperture 11 in the tabs 7 which are attached to the backpack 26, and therefore the pouch 25 will be coupled to the backpack 26.

In order to detach the pouch 25 from the backpack 26, the user simply moves each lever arm 32 across the slot back to its original position, whereby the wings 15 will be aligned with the rectangular sections of the apertures 11 in the tabs 7 attached to the backpack 26 (see FIGS. 11 and 12). Of course, in this position the key-like members 30 may be removed from the tabs 7 which are attached to the backpack 26.

As in the previous embodiments, the thickness of the wings 15 should be such that they snuggly fit in the gap between the elevated region 9 and the surface of the backpack 26 to which the tab 7 is attached to help retain the wings 15 in position. In addition, as in the previous embodiments, cooperating grooves 16 and bumps 12 may be provided on the wings 15 and the inner surface of the elevated region 9 to promote the stability of the wings 15 in the locked position.

The third embodiment has been described with a single pair of tabs 7 on support 28 which are horizontally disposed near the top edge of pouch 25. If desired, for even greater stability, a second pair of tabs on a support (not illustrated) may be horizontally attached near the bottom edge of pouch 25, with the lever arms projecting out from the bottom. Alternatively, the two pairs of tabs 7/supports 28 may be vertically attached near the side edges of the back surface 27 of the pouch 25, with the lever arms projecting out from the sides. Of course, the number and arrangement of the tabs 7 attached to the pouch 25 is not critical, provided that the user has access to the lever arms. The number of tabs preferably used is the number which will be sufficient to securely attach the pouch 25, and the number can vary depending upon the size of the pouch 25. Usually, one or two pairs of tabs will be sufficient.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense. For example, bumps 12 and grooves 16 may be unnecessary where the fit of the wings 15 beneath the elevated region 9 is sufficiently tight to hold the wings in position. In addition, bumps 12 and grooves 16 may be interchanged so that the bumps are on the wings 15 and the grooves are on the inner surface of the elevated region 9.

What is claimed is:

1. A system which couples a pouch or a case to a garment, comprising:

a tab attached to an outer surface of a garment, the tab having an elevated region which is spaced away from a padded region on said outer surface, and the elevated region defining an opening therein;

a coupling member which defines a structure which may be inserted into said opening, wherein the structure is selectively movable in said opening between a first position in which the structure may be removed from said opening and a second position in which at least a portion of the structure is situated in the space between the elevated region of the tab and the padded region of the outer surface of the garment, whereby said at least a portion of the structure is squeezed between the padded region and the elevated region of the tab to hold the coupling member to the tab; and the coupling member having a tab which is attached to the pouch or case.

2. The system according to claim 1, wherein the tab of the coupling member is stitched to a pouch.

3. The system according to claim 1, wherein said at least a portion of the structure includes at least one wing.

4. The system according to claim 3, wherein said at least a portion of the structure includes at least a pair of wings.

5. The system according to claim 4, wherein the structure includes a cylindrical region from which the wings project, and wherein the wings are spaced 180° apart from each other around the cylindrical region.

6. The system according to claim 5, wherein the opening in the elevated region of the tab member has a shape which corresponds to the shape of the cylindrical region and the adjoining pair of wings of the structure of the coupling member.

7. The system according to claim 4, further comprising a means for releasably locking the wings to the elevated region in the second position of the coupling member.

8. The system according to claim 7, wherein the means for releasably locking includes at least one bump on an inner surface of the elevated region and a groove in at least said one wing which receives the bump in the second position of the coupling member.

9. The system according to claim 1, wherein the elevated region includes a plurality of side walls, and wherein a pair of opposing side walls define a slot therein for coupling a webbing to the tab member.

* * * * *